United States Patent [19]

Watanabe et al.

[11] Patent Number: 4,771,625

[45] Date of Patent: Sep. 20, 1988

[54] APPARATUS FOR FORMING TAPERED THREADS ON PIPES

[75] Inventors: Takashi Watanabe, Warabi; Shigeyoshi Tanaka, Osaka, both of Japan

[73] Assignee: Kabushiki Kaisha Watanabe Kogyo, Toda, Japan

[21] Appl. No.: 947,268

[22] Filed: Dec. 29, 1986

[51] Int. Cl.[4] ..... B21H 3/04

[52] U.S. Cl. ..... 72/121

[58] Field of Search ..... 72/78, 104, 118, 121; 82/72; 10/120.5 R

[56] References Cited

U.S. PATENT DOCUMENTS

| | | | |
|---|---|---|---|
| 1,368,413 | 2/1921 | Stiefel | 72/78 |
| 2,583,094 | 1/1952 | Girz | 10/120.5 R |
| 3,058,196 | 10/1962 | Bour | 72/78 |
| 3,379,042 | 4/1968 | Brown | 72/78 |
| 3,522,747 | 8/1970 | Brownstein | 82/72 |

*Primary Examiner*—Lowell A. Larson

*Attorney, Agent, or Firm*—Stevens, Davis, Miller & Mosher

[57] ABSTRACT

An apparatus for forming tapered threads on a pipe such as a gas pipe comprises a base table on which a chuck device for holding a pipe is mounted in an opposing relation to a casing also mounted on the base table. A rotary disc is mounted on one side of the casing to be rotatable and a plurality of, at least three, die supporting plates are pivoted on one side of a rotary member integrally formed to the rotary disc. A plurality of rolling dies detachably attached to the disc supporting plates, respectively, and the rolling dies are rotated through a power transmission mechanism operatively connected to a drive source. To the respective die supporting plates are fitted a operational wheel to be movable axially with respect to the rotary members, the operational wheel being provided with a circumferential groove formed on the outer periphery thereof, to which a slidable ring is fitted, and a manipulative wheel is pivoted by a pair of pins positioned in the diametrical direction to the slidable ring, the manipulative wheel shifted by 90° with respect to the pins being pivoted to the casing.

5 Claims, 3 Drawing Sheets

APPARATUS FOR FORMING TAPERED THREADS ON PIPES

BACKGROUND OF THE INVENTION

This invention relates to a thread roll-forming or thread-rolling apparatus particularly adapted to provide tapered screw threads on, for example, gas pipes and pipe fittings.

In one conventional method of forming tapered screw threads on the end portion of a pipe such as a gas pipe, the screw threads are formed by means of threading dies, which cut the threads and remove material. The inner diameter of the pipe thus machined remains constant, whereby the pipe wall thickness decreases progressively toward the extremity of the pipe, the strength of which at its end portion is thereby lowered.

In another conventional method, rolling dies are pressed toward the end portion of a pipe to form rolled threads without cutting the pipe, whereby the pipe material is not damaged, and the effective strength of the screw threads is preserved. However, this conventional method entails a number of difficulties as will be described more fully herinafter.

SUMMARY OF THE INVENTION

Accordingly, it is the primary object of the present invention to overcome the difficulties encountered with the conventional thread-rolling apparatus and to provide a thread-rolling apparatus which is compact and light in weight for easy handling, and is furthermore, capable of producing tapered threads with a variety of sizes with the employment of exchangeable thread rolling dies.

This and other objects can be achieved, according to this invention, by providing an apparatus for forming tapered threads on a pipe comprising a base table, on which a chuck device and a casing are mounted in an opposing positional relation, a rotary disc rotatably mounted on one side of the casing, a plurality of die supporting plates pivoted on one side of rotary members integrally formed to the rotary disc, a plurality of rolling dies detachably attached to the die supporting plates, respectively, a power transmission gear mechanism operatively connected to a drive source and disposed on the rotary member for rotating the rolling dies, operational wheels fitted to the die supporting plates, respectively, to be movable axially with respect to the rotary members, each of the operational wheel being provided with a circumferential groove formed on the outer periphery thereof, to which a slidable ring is fitted, and a manipulative wheel pivoted by a pair of pins positioned in diametrical direction to the slidable ring, the manipulative wheel shifted by 90° with respect to the pins being pivoted to the casing.

DETAILED DESCRIPTION

As conductive of a full understanding of this invention, the general nature, attendant difficulties, and limitations of the conventional thread-rolling technique and apparatus will first be briefly described with reference to FIGS. 1 and 2.

Figure 1:
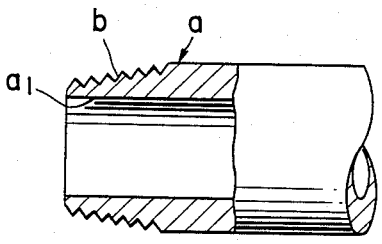
FIG. 1 PRIOR ART
FIGS. 1 and 2 are side views, partially in longitudinal section, showing tapered threads of gas pipes of prior art technique.

FIG. 1 shows a typical example of a conventional pipe or a pipe fitting, which has tapered screw threads b at one of its open end al of a pipe body a. In the prior art technique, tapered screw threads b are formed by means of threading dies; the one end al of the pipe body a has a reduced thickness; and, according to this conventional method, the material of the pipe body is removed away, whereby the effective strength of the screw heads is adversely affected.

Figure 2:
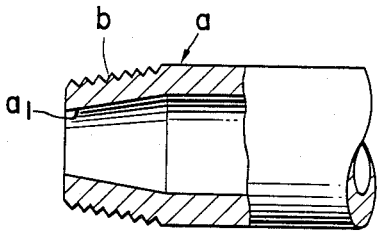
FIG. 2 PRIOR ART

A pipe body a shown in FIG. 2 is also provided with tapered screw threads b which are produced by rolling dies. In this conventional method, the rolling dies are pressed toward a pipe to form threads without cutting the same, so that the structure of the material is not damaged and the effective strength of the screw threads is also not weakened. However, the conventional thread-rolling apparatus using the rolling dies must incorporate a die supporting mechanism for supporting the roller dies which is made to cooperate with a link mechanism and a cam mechanism. Accordingly, the number of component parts of the apparatus increases, and the structure of the apparatus is made complex. In addition, it is difficult to troublesome to assemble and adjust these component parts, and the maintenance thereof is also troublesome, thus being uneconomical in labour and time. The enlargement of the whole apparatus is apt to require complicated operation and make it impossible to manually transfer the apparatus to a place for installation of pipes such as gas pipes.

The above described difficulties have been overcome in the thread rolling apparatus of this invention which will now be described with respect to preferred embodiments thereof with reference to FIGS. 3 through 8.

Figure 3:
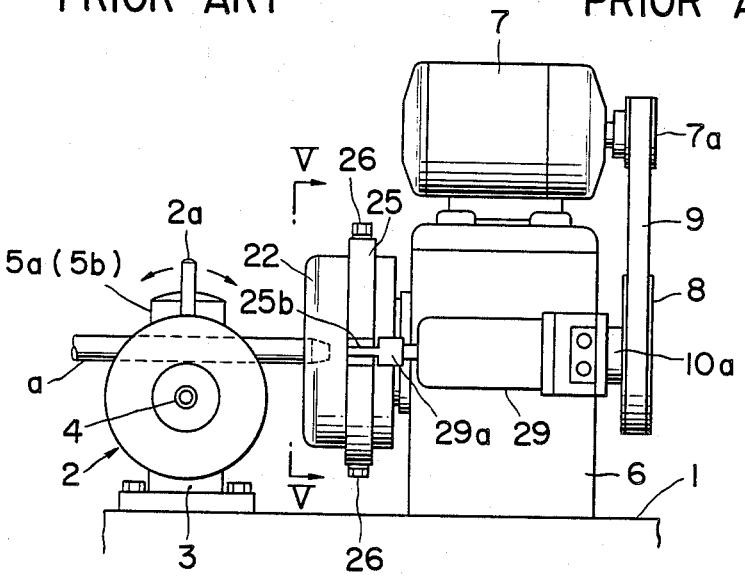
FIG. 3 is a side elevation showing one example of the thread-rolling apparatus of this invention.
Figure 4:
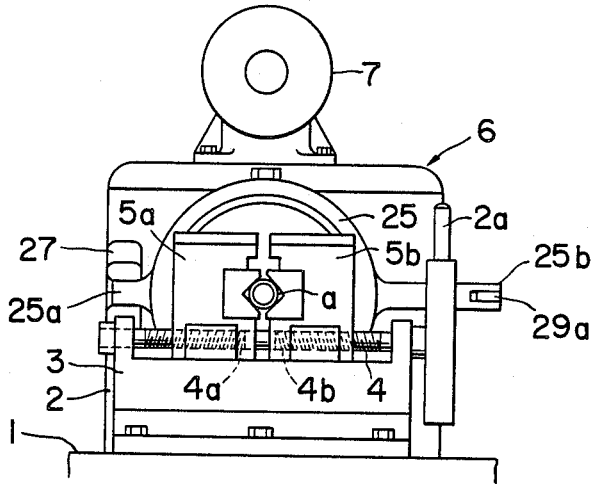
FIG. 4 is an end elevation of the apparatus shown in FIG. 3.

Referring to FIGS. 3 through 8, reference numeral 1 designates a flat base table on one side of which a chuck device 2 having a handle 2*a* is provided to firmly hold a work a, for example, a gas pipe. The chuck device 2 has a frame 3 fixedly mounted on the base 1, and a threaded transfer bar 4 is horizontally and rotatably mounted on the frame 3 and provided with a right-hand screw 4*a* and a left-hand screw 4*b*. As shown in FIG. 4, the right-hand screw 4*a* and the left-hand screw 4*b* are engaged with chuck elements 5*a* and 5*b* respectively, both being provided with a V-shaped recess for holding therein the work a. The transfer bar 4 has a handle 2*a* fixed thereupon.

According to the rotational movement of the transfer bar 4 through the operation of the handle 2*a*, the chuck device 2 can firmly hold the work a by means of the chuck elements 5*a* and 5*b*.

On the other hand, a casing 6 is disposed on the base table 1 to face the chuck device 2 with a certain distance therebetween. An electric driving motor 7 is mounted on the casing 6 and has a rotar shaft 7*a* which is coupled to a follower wheel 8 via a transfer belt 9. A horizontal rotational shaft 10*a* fixed to the follower wheel 8 is rotatable in the same direction as a rotational disc 10 which is also fixed to the shaft 10a on the other side of the casing 6.

Figure 5:
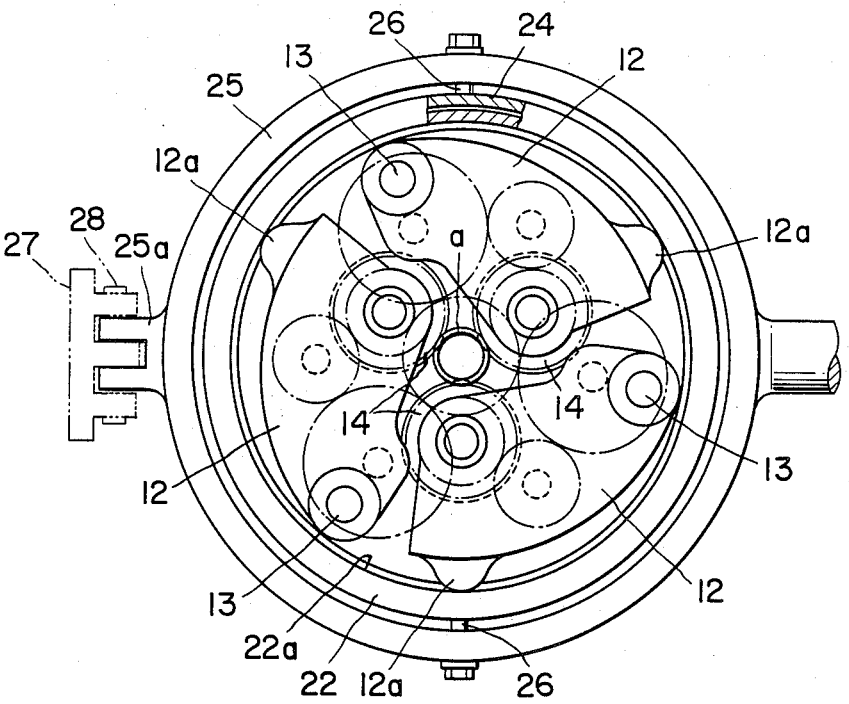
FIG. 5 is a relatively enlarged end view taken in the plane indicated by line III—III in FIG. 3 as viewed in the arrow direction.
Figure 6:
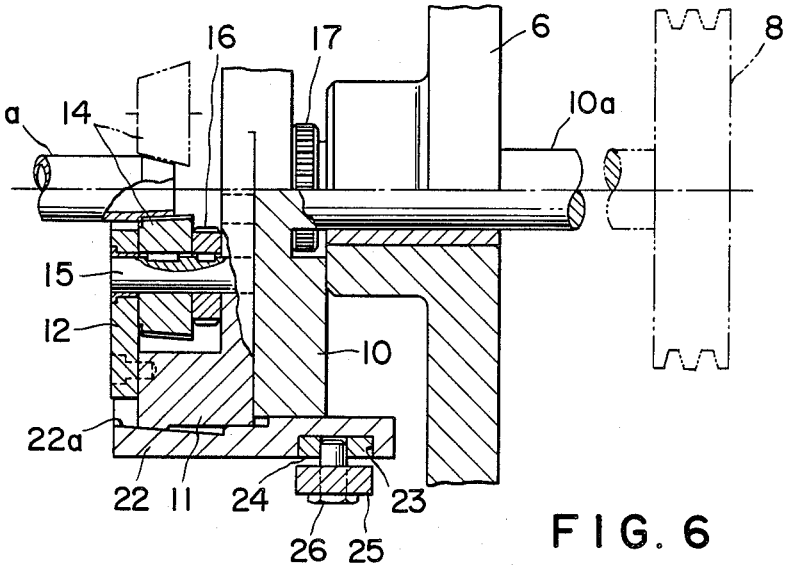
FIG. 6 shows a partial side view, in vertical section of a thread-rolling part of the apparatus.

As shown in FIG. 6, on the other end of the rotational shaft 10*a* there is provided a rotary member 11 substantially integral with the shaft 10*a*. As shown in FIG. 5, on the side of the rotary member 11 a set of at least three die supporting plates 12 are pivotally supported by pivot pins 13, respectively. Furthermore, at a position, on each die supporting plate 12, apart from the pin 13, is provided a thread-rolling die 14 each of which is pivotally supported on a pin shaft 15 and detachably and coaxially aligned with a corresponding gear 16. Each gear 16 is operatively connected to a sun gear 17, which is mounted on the shaft 10a by means of a gear transfer mechanism 18.

Figure 7:
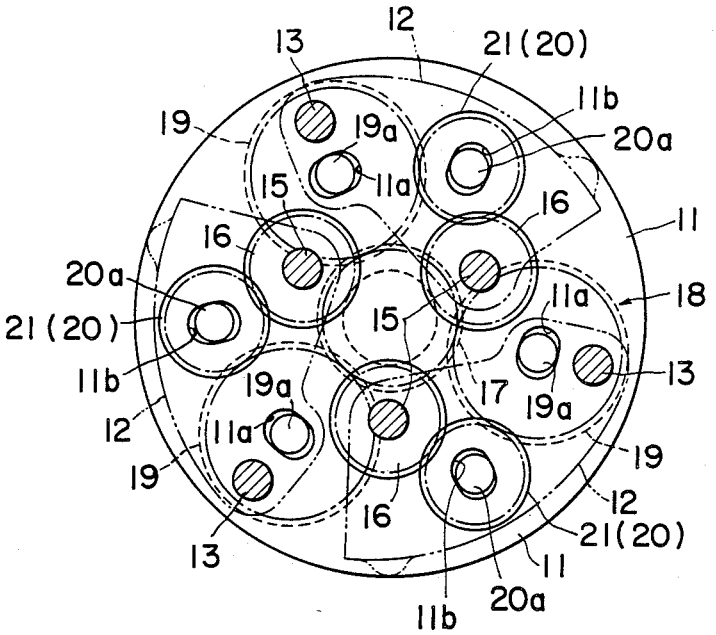
FIG. 7 is a front view of a power transmission gear mechanism assembled in the apparatus of this invention.
Figure 8:
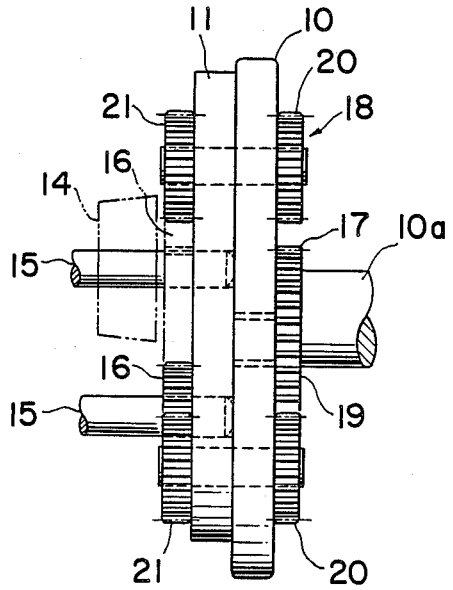
FIG. 8 is a side view of the mechanism shown in FIG. 7.

More specifically, as clearly illustrated in FIGS. 7 and 8, the gear transfer mechanism 18 extends across opposite sides of the rotary member 11 and the rotational disc 10. A first gear 19 engaging with the sun gear 17 meshes with a second gear 20, and a third gear 21 coaxially aligned with the second gear 20 in turn engages with the gear 16 to impact rotation to the thread-rolling die 14 (see FIG. 8). Pins 19a and 20a for supporting the first and second gears 19 and 20 respectively are loosely accommodated in elongated apertures 11*a* and 11*b* which are provided in the rotational disc 11. The elongated apertures 11*a* and 11*b* are provided with enough room so that, when the die supporting plates 12 move with respect to the pins 13, the positions thereof can be freely changed within the apertures (see FIG. 7).

Referring to FIG. 5, on the external peripheral end of each die supporting plate 12 is provided an arcuate contact projection 12*a*. An operaational wheel 22, which has an internal tapered surface 22*a* to contact the arcuate contact projection 12*a*, is aligned with the external peripheral surfaces of both the rotational disc 10 and the rotary member 11 to be slidable along the axial direction. As shown in FIG. 6, there is also provided, on the external peripheral surface of the operational wheel 22, a groove 23 extending around the entire circumference thereof. A slidable ring 24 is loosely fitted in the groove 23. Around and outside the slidable ring 24, a manipulative wheel 25 is positioned so as to circumscribe the ring 24 mounted therreupon by means of a pair of diametrically opposed fasteners 26. A hinge member 25*a* formed at a portion of the manipulative wheel 25 shifted by 90° with respect to the two fasteners 26 is pivoted on a bracket 27 of a stationary member, i.e., in this embodiment, by means of a pin 28 (see FIG. 5). On the opposite side of the wheel 25 relative to the hinge member 25*a*, a manipulative bar 25*b* is fixed, and an actuating rod 29*a* of a hydraulic cylinder device 29 is coupled to the end of the manipulative bar 25*b* as shown in FIG. 3.

In actual operation, one end of the work a, for example, a gas pipe is prepartorily formed so as to exhibit a tapered portion by a pipe drawing machine.

In the second step, the work a is temporarily but firmly held between the chuck elements 5*a* and 5*b* of the chuck device 2 by rotating the handle 2*a* (see FIG. 3).

The follower wheel 8 is driven by the motor 7 through the output shaft 7*a* and the belt 9. Therefore, as shown in FIGS. 6 and 8, the rotational disc 10 and the rotary member 11 are rotated in accordance with the rotation of the shaft 10*a*, and the gear transfer mechanism 18 then drives the rolling dies 14, which are coaxially aligned with respective gears 16.

In the next step, the hydraulic cylinder device 29 is activated thereby to push manipulative bar 25*b* through the actuating rod 29*a* leftwardly as viewed in FIG. 6 and to rotate the same with the pin 28 as a pivot. The operational wheel 22 connected to the manipulative bar 25*b* through the fasteners 26 also moves slightly leftwardly as shown in FIG. 6, that is, the operational wheel 22 moves in the axial direction with respect to the work a. In accordance with the axial movement of the wheel 22, the contact projections 12*a* abutting against the tapered portion 22*a* rotates around the pivot 13 in the axial direction of the work a. Accordingly, each die supporting plate 12 urges and presses its rotating rolling die 14 thereby to cause it to bite into the tapered portion of the work a and to form a tapered screw threads.

Finally, the actuating rod 29*a* of the hydraulic cylinder device 29 is returned to its original position and the process for forming tapered screw threads to the work is completed. The work a is thereafter released from the chuck device 2. Thus, tapered screw threads for a gas pipe are generated by the thread rolling dies 14.

What is claimed is:

1. An apparatus for forming tapered threads on a pipe comprising:

a base table;

a chuck means for holding the pipe, mounted on said base table;

a casing mounted on said base table at a portion opposing to said chuck means;

a rotary disc rotatably mounted on one side of said casing;

a rotary member integrally formed with said rotary disc;

a plurality of die supporting plates pivoted on one side of said rotary member;

a plurality of thread-rolling dies for forming tapered threads on the pipe, said dies being detachably attached to said die supporting plates, respectively;

a power transmission gear means operatively connected to a drive source and disposed on said rotary member for rotating said rolling dies;

an operational wheel fitted to said die supporting plates to be movable axially with respect to said rotary member, said operational wheel being provided with a circumferential groove formed on the outer periphery thereof;

a slidable ring which is fitted in the circumferential groove; and a manipulative wheel pivoted by a pair of pins positioned in diametrical direction to said slidable ring, said manipulative wheel being pivoted on a portion of the casing angularly shifted shifted by 90° with respect to said pins.

2. The apparatus according to claim 1 wherein each of said die supporting plates is provided at the circumferential portion with a contact projection abutting against a tapered portion of said operational wheel.

3. The apparatus according to claim 1 wherein a handle member is secured to one end of said operational wheel.

4. The apparatus according to claim 1 wherein at least three die supporting plates are disposed in association with said rotary disc.

5. The apparatus according to claim 1 wherein said chuck means comprises a pair of pipe holding chuck elements to which V-shaped pipe holding blocks are secured detachably.

* * * * *